US005984167A

United States Patent [19]

Roccaforte

[11] Patent Number: 5,984,167

[45] Date of Patent: Nov. 16, 1999

[54] ENVELOPE WITH TAB LOCKS AND CASSETTE HOLDER

[75] Inventor: Harry I. Roccaforte, Chicago, Ill.

[73] Assignee: Rock-Tenn Company, Norcross, Ga.

[21] Appl. No.: 09/115,926

[22] Filed: Jul. 15, 1998

[51] Int. Cl.[6] ..... B65D 27/22

[52] U.S. Cl. ..... 229/84; 206/455; 229/67.4; 229/67.1

[58] Field of Search ..... 206/454, 455, 206/456; 229/87.1, 67.3, 72, 301, 67.4, 82, 84

[56] References Cited

U.S. PATENT DOCUMENTS

| | | | |
|---|---|---|---|
| 1,225,924 | 5/1917 | Burris | 229/84 |
| 1,229,081 | 6/1917 | Hoffman | 229/84 |
| 1,367,601 | 2/1921 | Hodgson | 229/84 |
| 1,461,727 | 7/1923 | Deubener | 229/84 |
| 1,738,562 | 12/1929 | Cather | 229/84 |
| 2,135,865 | 11/1938 | Winokar | 129/16.7 |
| 2,189,273 | 2/1940 | Shomaker | 229/84 |
| 2,289,058 | 7/1942 | McCarthy | 229/84 |
| 2,405,914 | 8/1946 | Rosen | 229/84 |
| 3,111,256 | 11/1963 | Hiersteiner | 229/63 |
| 3,278,015 | 10/1966 | Bernstein | 206/47 |
| 5,678,754 | 10/1997 | Kranz | 229/72 |
| 5,788,074 | 8/1998 | Tanabe et al. | 206/455 |
| 5,806,754 | 9/1998 | Boyle | 229/72 |
| 5,816,392 | 10/1998 | Kawagoe et al. | 206/232 |
| 5,823,330 | 10/1998 | Werner et al. | 206/232 |
| 5,833,059 | 11/1998 | Werner et al. | 206/232 |

FOREIGN PATENT DOCUMENTS

| | | | |
|---|---|---|---|
| 303537 | 12/1932 | Italy | 229/82 |
| 432073 | 7/1935 | United Kingdom | 229/72 |

*Primary Examiner*—Paul T. Sewell
*Assistant Examiner*—J. Mohandesi
*Attorney, Agent, or Firm*—Schwegman, Lundberg, Woessner, & Kluth, P.A.

[57] ABSTRACT

An envelope is disclosed which includes a back panel hingedly coupled with a front panel, where side panels foldably coupled with the back panel are folded over the front panel. The side panels are partially secured to the front panel each having a portion which is unsecured to the front panel. A closure panel is hingedly coupled with the back panel and has at least one closure tab coupled therewith. The closure tabs are adapted to be engaged by the side panels and the front panel, where the closure tabs are disposed between the front panel and the side panels where the side panels are unsecured with the front panel. A cassette holder is also incorporated and can be coupled with the closure panel of the front panel.

27 Claims, 12 Drawing Sheets

ENVELOPE WITH TAB LOCKS AND CASSETTE HOLDER

CROSS REFERENCE TO RELATED APPLICATIONS

This application is related to the co-pending, commonly assigned U.S. patent application: Application Ser. No. 09/040,199, entitled "PHOTO FOLDER WITH CASSETTE HOLDER," filed on Feb. 27, 1998, which is assigned to the assignee of the present invention, and the entire disclosure being incorporated herein by reference.

FIELD OF THE INVENTION

The present invention relates generally to an apparatus for holding objects therein. More particularly, it pertains to an envelope with tab locks and a cassette holder.

BACKGROUND OF THE INVENTION

Folders for holding photo prints are currently produced from a relatively flimsy or flexible paper material having a single print pocket. The print pockets are sometimes expandable along the side edges but not the bottom edge of the folder. Some folders also include an expandable bottom end as well. Additionally, some folders have an extra pocket in front of the print pocket for holding the photo print negatives.

Conventional paper folders do not provide a sturdy, long-term storage container for photographs and negatives. The paper is generally flexible and flimsy and does not provide protection for the prints and negatives held within the folder. Additionally, the conventional paper material is not sturdy enough for a rigorous process of imprinting sophisticated promotional and advertising information on the folders which is necessary in today's competitive market.

The release of the Advanced Photo System (APS) has presented additional issues relating to packaging, handling, and ordering prints. The APS allows a user to choose from different types of prints, having differing sizes, including classic, HDTV, and panoramic. With APS, the film is provided in the form of a cartridge or a cassette. The film processing machines remove the film from the cassette and automatically replaces the film back in the cassette after processing. During the printing process, a printer automatically removes the film, prints, and replaces the film back in the cassette. After the film is processed, an index print is provided which displays all of the photos of the film. When ordering re-prints, the consumer must provide the negative to the photo processor, which film is in the form of the cassette.

One approach in providing a folder for the APS is an envelope having expandable sides, a single pocket, and a cassette holder is formed next to the pocket as part of the expandable side. One drawback is that the length of the envelope is extended by the size of the cassette, thereby rendering the envelope incompatible with conventional equipment of the photo industry. Another disadvantage is that the cassette is freely disposed within the cassette holder, and can become easily misplaced from the index print and/or the order card if the cassette is expelled from the cassette holder.

For larger prints, a larger and more sturdy envelope must be provided since they are more vulnerable to damage. One approach in providing a larger folder for enlargements using the APS is an envelope having a cassette holder coupled with a back panel of the folder. Tabs for closing the envelope are provided on a closure panel which are insertable into slits on a front panel of the envelope, where the tabs come into direct contact with prints inserted into the envelope. One drawback is that the closure tabs can damage the prints and/or other documents which are contained within the envelope, particularly if the tabs are repeatedly inserted, removed, and again inserted. An extra panel is sometimes provided with the front panel to prevent contact of the tabs with the photos, however, this adds extra material and extra cost to the fabrication of the blank.

Accordingly, what is needed is a print folder produced from a single unitary material and which is readily substituted for a conventional paper folder and compatible with existing automatic photo processing machines. What is further needed is a better way to provide storage, handling of prints and re-prints for the APS. What is still further needed is a print folder which may be produced from a relatively sturdy material such as paperboard suitable for long-term storage of objects therein, printing of sophisticated promotional material thereon, and is biodegradable and recyclable.

SUMMARY OF THE INVENTION

An envelope is provided which is adapted for safely holding photo prints therein. In one embodiment, the envelope has a front panel hingedly coupled with a back panel, a side panel hingedly coupled with each side of the back panel and folded over the front panel, where the side panels are partially attached to the front panel, such that each side panel has an unattached portion. A closure panel is hingedly coupled with the back panel with a first closure tab and a second closure tab hingedly coupled therewith. The closure tabs are engaged by the unattached portion between the side panel and the front panel.

The envelope can also be optionally provided with a cassette holder. The cassette holder can be coupled with the closure panel or the front panel. In addition, the cassette holder can comprise blister packaging disposed through a cut out of the envelope. Alternatively, the cassette holder can comprise a plurality of side panels which are hingedly coupled with one another. One of the side panels optionally includes adhesive for assembly of the cassette holder.

In another configuration, the envelope is also provided with a blister panel which is removably coupled with the envelope. The blister panel allows a user to optionally install the cassette holder. A retention panel is coupled with the envelope, in another embodiment, which is adapted to secure the cassette holder with the envelope.

In yet another embodiment, a blank is provided for forming an envelope. The blank includes a front panel hingedly coupled with a back panel, a first side panel hingedly coupled with a first side of the back panel, and a second side panel hingedly coupled with a second side of the back panel. The first side panel and the second side panel each have adhesive, where the adhesive includes a first adhesive strip and a second adhesive strip, and the first adhesive strip is disposed apart from the second adhesive strip to create a portion in between without adhesive. In addition, a closure panel is hingedly coupled with the back panel. First and second closure tabs are hingedly coupled with the closure panel.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DESCRIPTION OF THE EMBODIMENTS

In the following detailed description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural changes may be made without departing from the scope of the present invention. Therefore, the following detailed description is not to be taken in a limiting sense, and the scope of the present invention is defined by the appended claims.

Figure 1A:
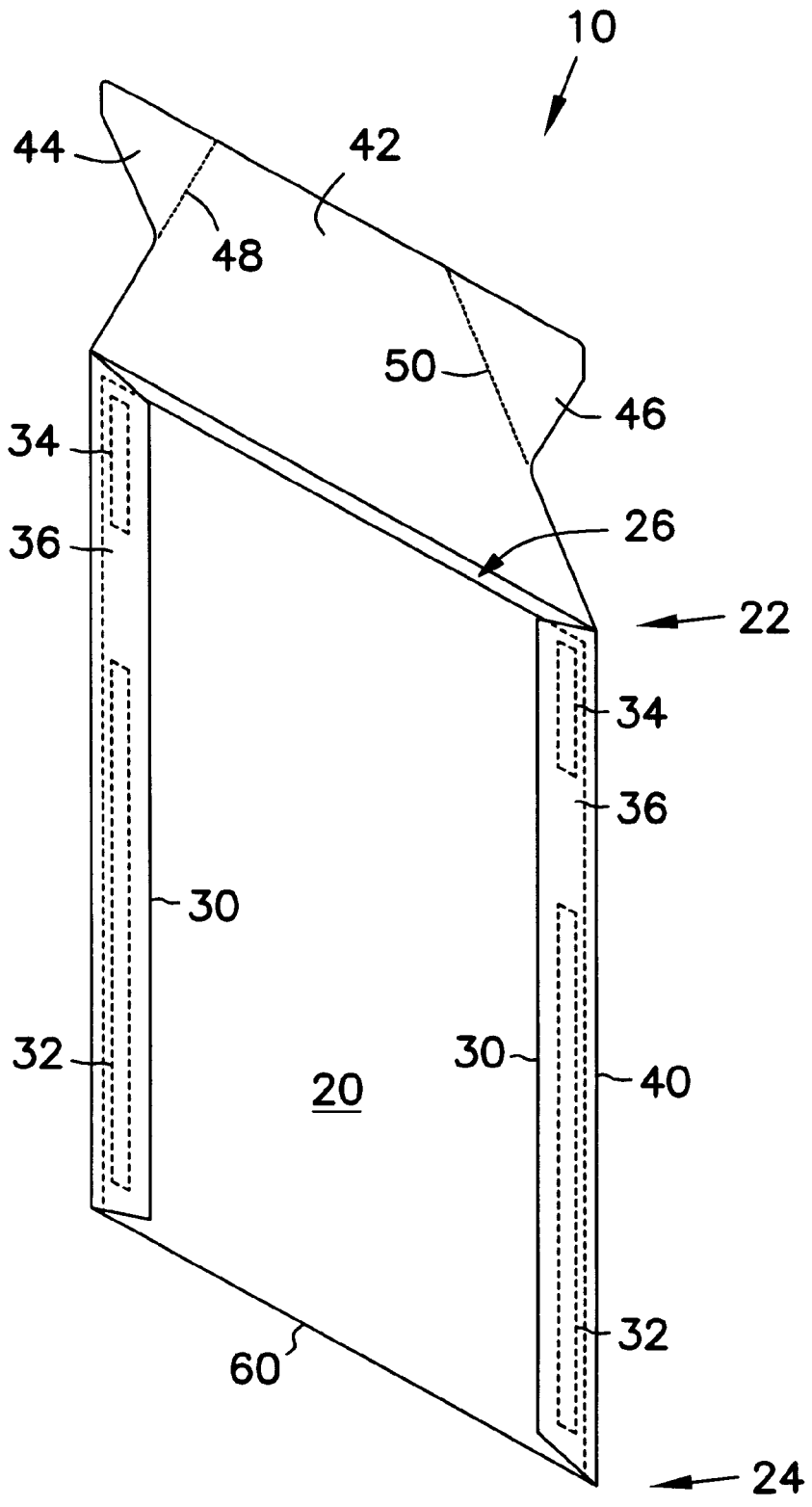
FIG. 1A is a perspective view illustrating an envelope constructed in accordance with one embodiment of the present invention.
Figure 1B:
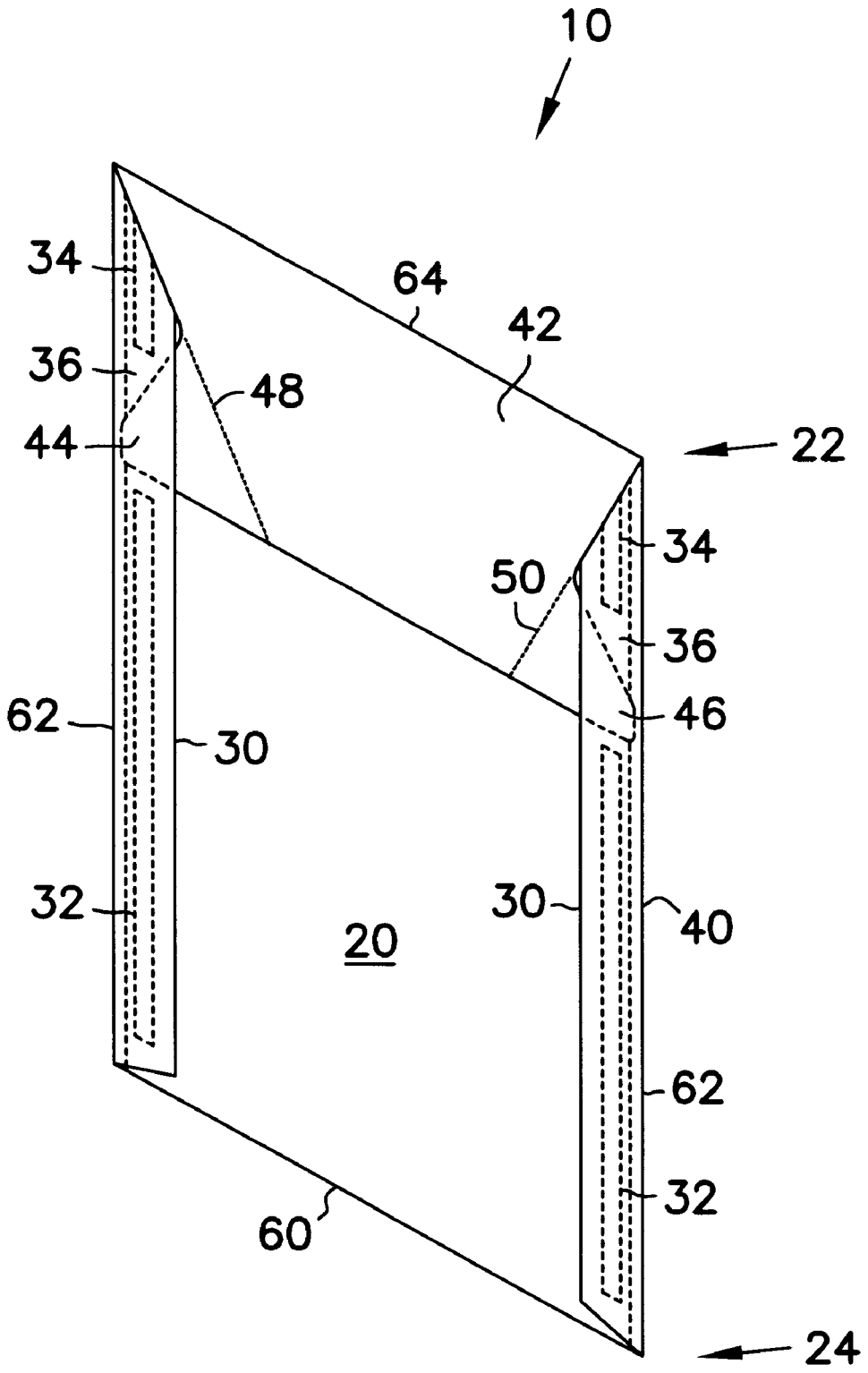
FIG. 1B is a perspective view illustrating an envelope constructed in accordance with another embodiment of the present invention.
Figure 2:
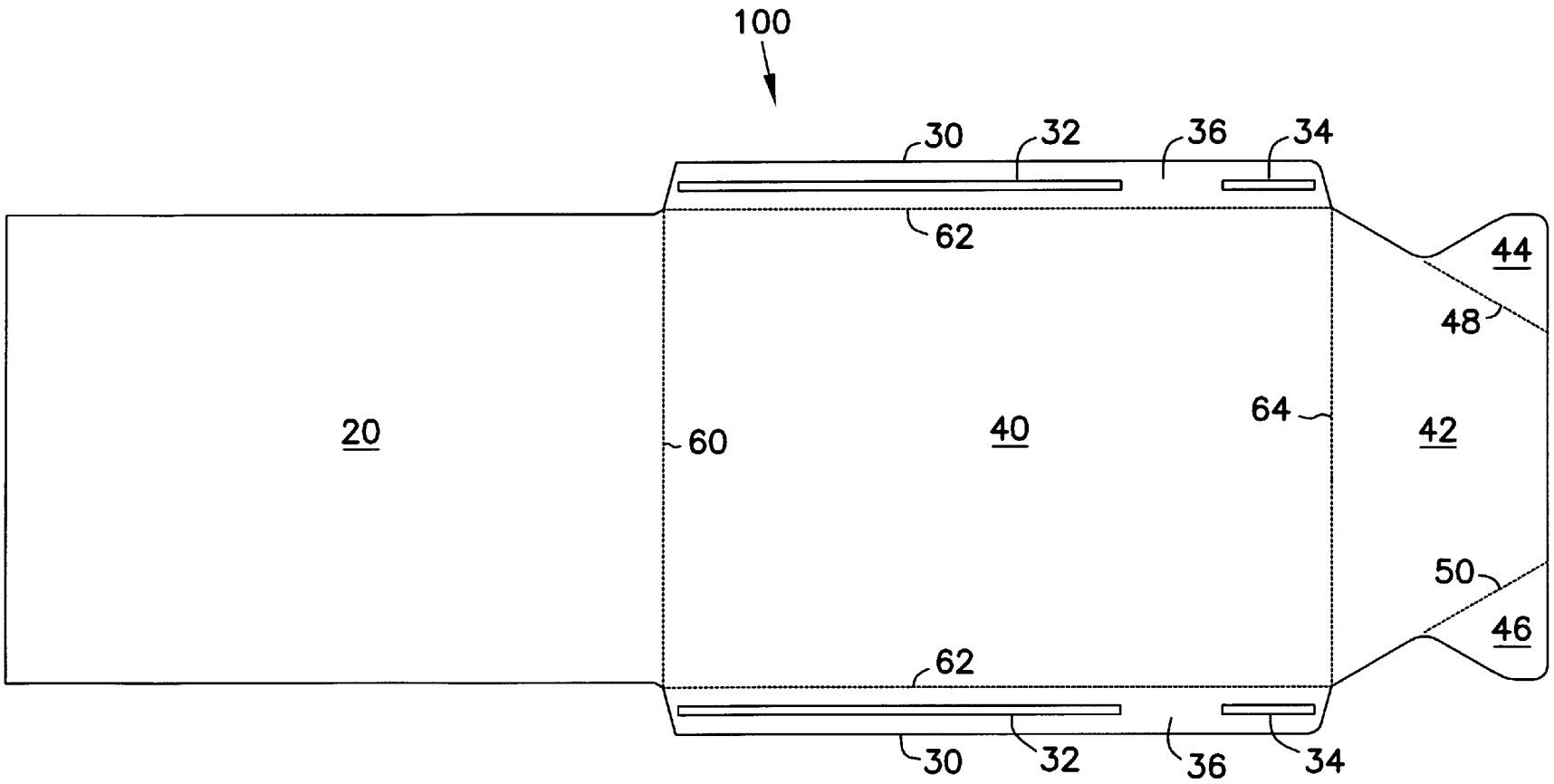
FIG. 2 is a first side elevational view illustrating a material blank for forming a envelope constructed in 10 accordance with one embodiment of the present invention.

The first embodiment of an envelope is illustrated in FIGS. 1A, 1B and 2. The formed envelope 10 is illustrated in greater detail in FIGS. 1A and 1B, and a blank 100 for forming the envelope 10 is shown in FIG. 2. The envelope 10 extends from a first portion 22 to a second portion 24 and comprises a front panel 20, side panels 30, back panel 40, and closure panel 42 which fold up together to form the envelope 10. The front panel 20 is foldably attached to the back panel 40 at a fold line 60. Similarly, the back panel 40 is foldably attached to side panels 30 at fold lines 62. The back panel 40 is also foldably attached to the closure panel 42 at fold line 64. The closure panel 42 includes at least one closure tab. In one embodiment, the closure panel 42 includes a first closure tab 44 and a second closure tab 46 which are adapted to retain the closure panel 42 in a closed position, as shown in FIG. 1B. In one embodiment, the first and second closure tabs 44, 46 are foldably attached with the closure panel 42 at a first fold line 48 and a second fold line 50, respectively.

Side panels 30 are folded over the front panel 20 thereby forming a pocket 26 between the back panel 40, the front panel 20, and the side panels 30. The side panels 30 are partially secured to the front panel 20. In one embodiment, adhesive is disposed between the side panel 30 and the front panel 20 to secure the envelope 10 as shown in FIG. 1. In one embodiment, the adhesive comprises a first adhesive strip 32 and a second adhesive strip 34. The first adhesive strip 32 and the second adhesive strip 34 can be placed on either the side panels 30 or the front panel 20. The first adhesive strip 32 is disposed apart from the second adhesive strip 34 such that therebetween is a portion without adhesive 36, which forms an unattached portion between the front panel 20 and each of the side panels 30. Other methods for forming an unattached portion can also be used such as skipping adhesive or other equivalents. The portion without adhesive 36 is adapted to receive the closure tabs 44, 46 therein, to secure the envelope 10 in a closed position. Although the term "without adhesive" is used to describe the portion for receiving the closure tabs 44, 46, the description is not intended to limit the disclosure to the use of adhesive alone. Other equivalent structures for attaching or securing the side panels 30 with the front panel 20, such as mechanical attachment or mechanical fasteners, can be used and are considered within the scope of the invention.

To close the envelope 10, the closure panel 42 is folded over the front panel 20. Concurrently, first and second closure tabs 44, 46 are folded about the first and second fold lines 48, 50, respectively and inserted into the space between the side panels 30 and the front panel 20 at the portion without adhesive 36. The closure tabs 44, 46 are engaged by the side panels 30 and retain the closure tabs 44, 46 therein. Since the closure tabs 44, 46 are received between the side panels 30 and the front panel 20, the first and second closure tabs 44, 46 do not damage the prints or documents contained within the envelope 10, nor is an extra protective flap of material required. With the closure tabs 44, 46 inserted into the portion without adhesive 36, the envelope 10 is closed as illustrated FIG. 1B.

Figure 3:
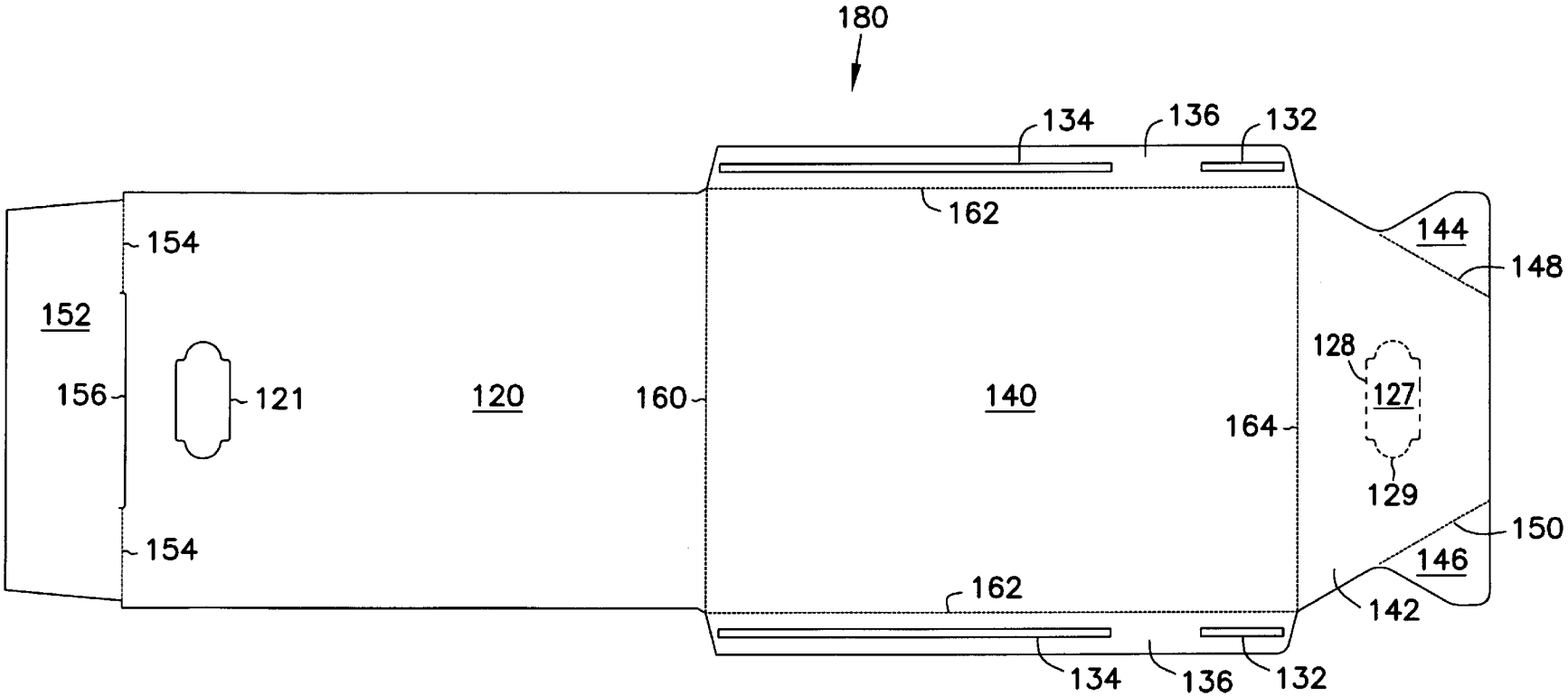
FIG. 3 is a first side elevational view illustrating a material blank for forming a envelope constructed in accordance with another embodiment of the present invention.

FIG. 3 illustrates a blank 180 for forming an envelope 110 in another embodiment. The blank 180 includes a closure panel 142, a back panel 140 and a front panel 120. In addition, the blank includes a retention panel 152. The closure panel 142 is hingedly coupled with the back panel 140 at fold line 164. The blank 180 also includes side panels 130 which are hingedly coupled with the back panel 140 at fold lines 162. The back panel 140 is also hingedly coupled with the front panel 120 at fold line 160. The front panel 120 has a cut out 121 therein which is adapted to receive blister packaging 166 there through, as will be further discussed below. The retention panel 152 is hingedly coupled with the front panel 120 at fold lines 154. Disposed between the two fold lines 154 is a cut line 156.

In one embodiment adhesive is disposed on a portion of the blank 180. In one embodiment, a first adhesive strip 132 and a second adhesive strip 134 are disposed on each of the side panels 130. In another embodiment, the first adhesive strip 132 is spaced away from the second adhesive strip 134 allowing for a portion without adhesive 136 therebetween. Alternatively, other arrangements of the adhesive are possible, and are considered within the scope of the invention. For instance, the adhesive can be alternatively or additionally disposed on a portion of the front panel 120.

The closure panel 142, in another embodiment, has a blister panel 127 therein. The blister panel 127 is at least partially surrounded by a perforation 129, such that the blister panel 127 can be easily removed from the blank 180, if needed. Once the blister panel 127 is removed, an aperture 128 is formed therein. The aperture 128 is adapted for receiving a cassette holder such as blister packaging 166 therethrough, as will be further discussed below. The closure panel 142 also includes at least one closure tab, which in one embodiment comprises a first closure tab 144 and a second closure tab 146. The first closure tab 144 and the second closure tab 146 are each foldably coupled with the closure panel 142 at the first fold line 148 and a second fold line 150, respectively.

Figure 4A:
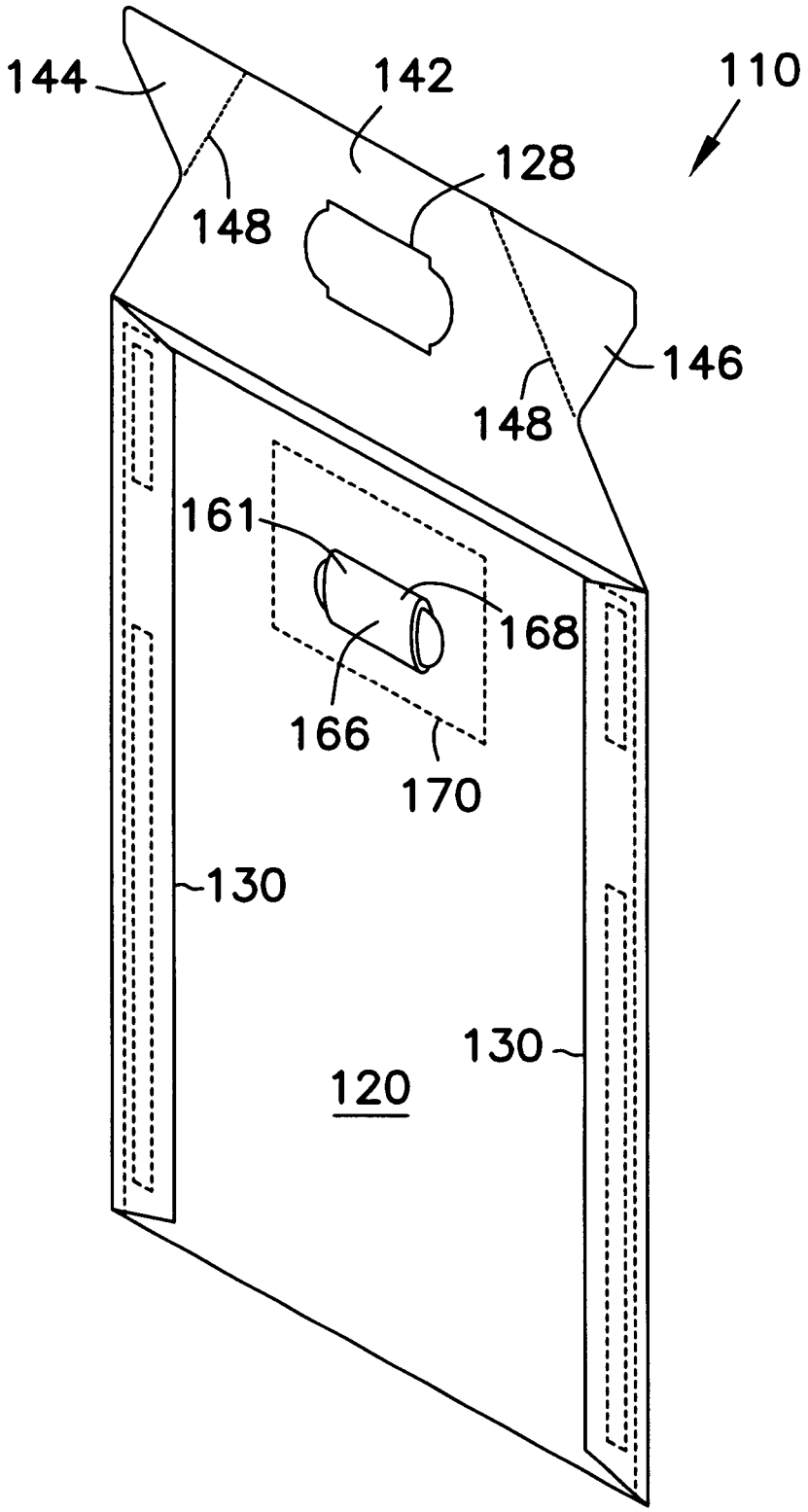
FIG. 4A is a perspective view illustrating an envelope constructed in accordance with one embodiment of the present invention.
Figure 4B:
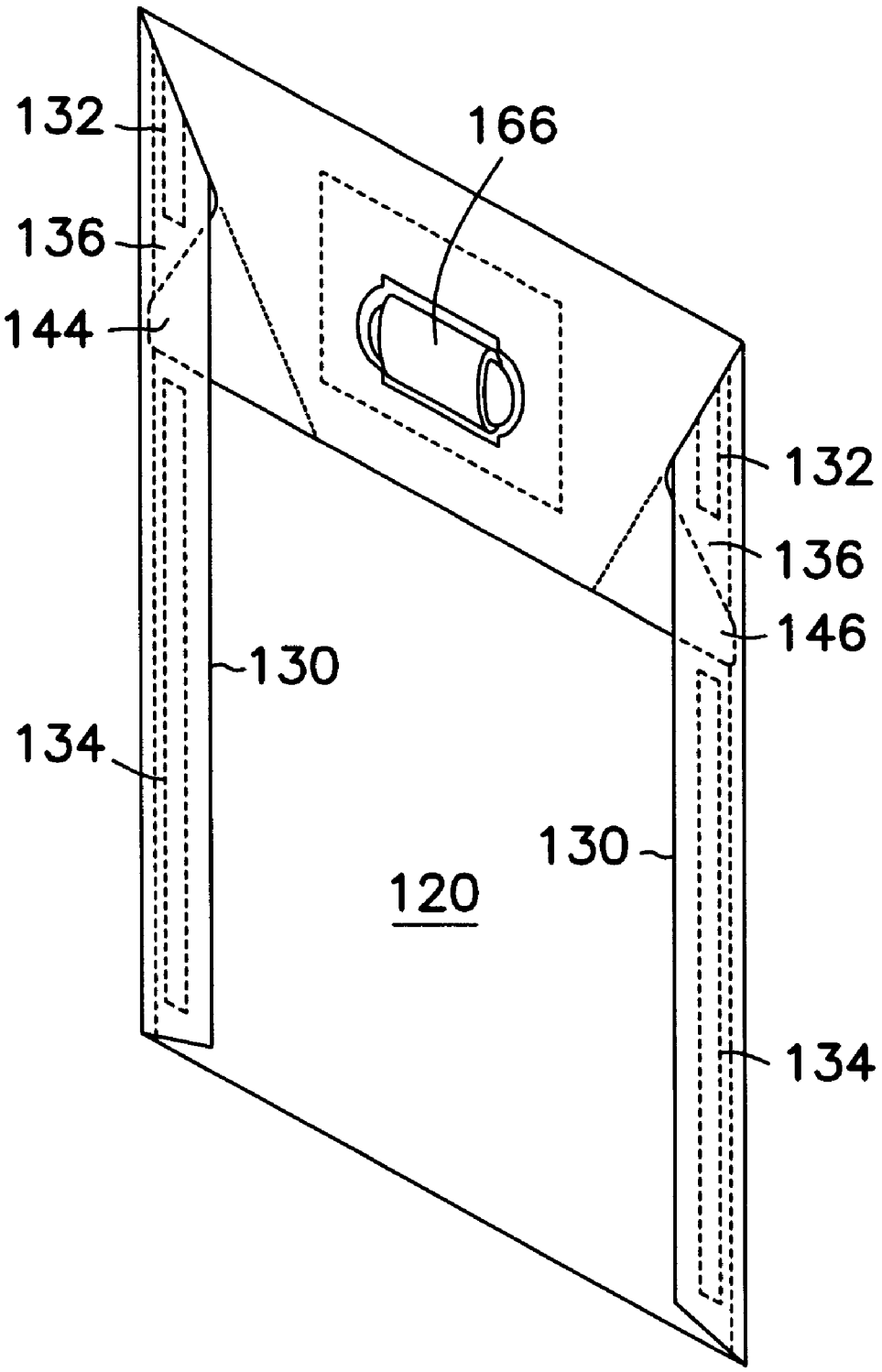
FIG. 4B is a perspective view illustrating an envelope 20 constructed in accordance with one embodiment of the present invention.

The blank 180 of FIG. 3 is used to form an envelope 110 as illustrated in FIGS. 4A and 4B. To form the envelope 110, a cassette holder such as blister packaging 166 is inserted through the cut out 121. The blister packaging 166 includes a retention flange 170 which has a projection 161 therein. The blister packaging 166 can be comprised of translucent material such that the cartridge can easily be identified by a user. The retention flange 170 is adapted to retain the blister packaging 166 to the envelope 110. The projection 161 forms a cavity 168 which is adapted for receiving a cassette (not shown) which is commonly used in advanced photo systems. Alternatively, the projection 161 can also receive other types of cartridges therein, and still be considered within the scope of the invention. The retention panel 152 is folded over the retention flange 170 of the blister packaging 166. The projection 161 is disposed through the cut out 121 and the retention flange 170 is disposed through the cut line 156. Alternatively, the retention flange 170 is disposed adjacent to or at least only partially through the cut line 156.

The front panel 120, along with the retention panel 152 and the blister packaging 166, are folded over the back panel 140. The side panels 130 are then folded over the fold lines 162 on top of the front panel 120 to secure the side panels 130 thereto. Alternatively, the components of the envelope 110 can be assembled in other manners. For instance the side panels 130 can be adhered to the front panel 120 prior to the assembly of the blister packaging 166. In this configuration the front panel is folded over the fold line 160 and the side panels 130 are folded over the fold lines 162 to adhere the side panels 130 to the front panel 120. The blister packaging 166 is then inserted such that the projection 161 is disposed through the cut out 121 and the retention panel 152 is folded over the blister packaging 166 to form the envelope 110 as shown in FIG. 4A. Alternatively, the envelope 110 can be assembled without the blister packaging 166 therein. The envelope 110 has a pocket 126 which is adapted to receive a variety of sizes of prints. The retention panel 152 advantageously protects any sensitive documents and or photographs which are disposed within the pocket, from the blister packaging 166. The envelope 110 can be formed in several ways, and the folding and adhering of the various components are not limited to the order discussed above. For instance, the blister packaging 166 can be assembled at any time during or after the formation process and is still considered within the scope of the invention.

To close the envelope 110, as shown in FIG. 4B, the closure panel 142 is folded over fold line 164. If blister packaging 166 is used, the blister panel 127 is removed from the closure panel 142. Once the blister panel 127 has been removed from the blank 180, the aperture 128 assembles over the projection 161 of the blister packaging 166. The first and second closure tabs 144, 146 are folded about their first and second fold lines 148, 150, respectively. The first and second closure tabs 144 and 146 are disposed within the portion without adhesive 136 of the envelope 110. A user has the advantage of optionally including blister packaging 166. Alternatively, if a user did not need or want blister packaging 166 for items such as a cassette, the user could leave the blister panel 127 assembled with the closure panel 142, to thereby provide a flat surface.

Figure 5:
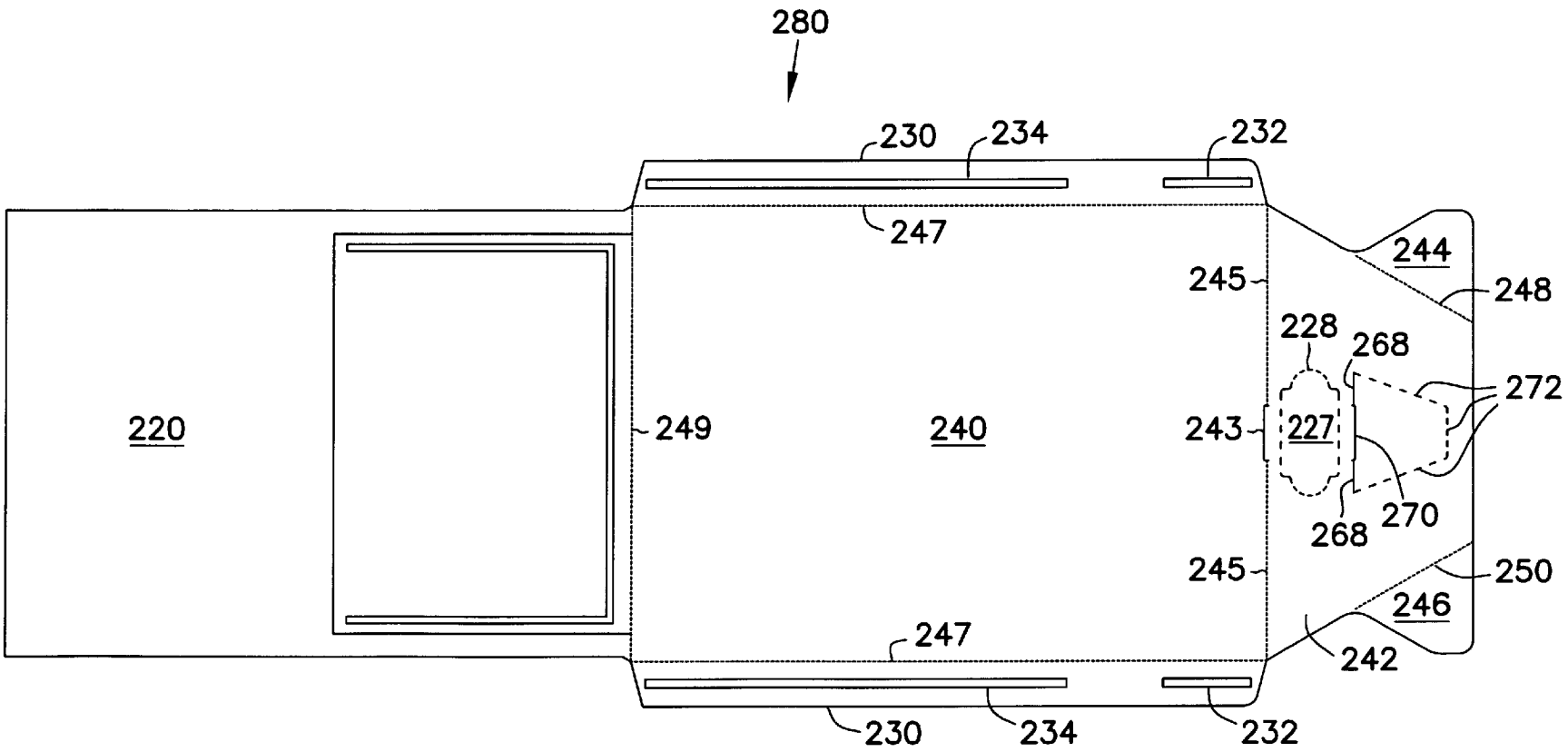
FIG. 5 is a first side elevational view illustrating a material blank for forming a envelope constructed in accordance with another embodiment of the present invention.

FIG. 5 illustrates a blank 280 for forming another embodiment of an envelope 210. The blank 280 includes a front panel 220 which is hingedly coupled with a back panel 240 at fold line 249. The back panel 240 has side panels 230 foldably coupled therewith. The side panels 230 are coupled with the back panel 240 along fold lines 247. The closure panel 242 is hingedly coupled with the back panel 240 along fold lines 245. The closure panel 242 is adapted to couple with blister packaging 260 as will be further described below.

The side panels 230 each have, in one embodiment, adhesive disposed thereon. In one embodiment, the adhesive comprises a first adhesive strip 232 and a second adhesive strip 234 disposed on each of the side panels 230. In another embodiment, the first adhesive strip 232 is disposed apart from the second adhesive strip 234 thereby creating a portion in between without adhesive 236. The portion without adhesive 236 is adapted to receive at least a portion of the closure panel 242 therein, which will be further described below. Alternatively, in another embodiment, the adhesive can be disposed on other portions of the blank 280. For instance, the adhesive can be disposed on a portion of the front panel 220.

The closure panel 242 includes a first closure tab 244 and a second closure tab 246 hingedly coupled therewith. The first closure tab 244 is hingedly coupled to the closure panel 242 along a first fold line 248. Similarly, the second closure tab 246 is hingedly coupled to the closure panel 242 along a second fold line 250. As stated earlier, the closure panel 242 is hingedly coupled with the back panel 240 along fold lines 245. Disposed between the fold lines 245, in one embodiment, is a cut line 243. The cut line 243 is adapted to receive a portion of the blister packaging 260 therethrough as will be further described below. The closure panel 242 also includes a blister panel 227. In one embodiment, the blister panel 227 is at least partially circumscribed by a perforated line, such that the blister panel 227 can be easily removed from the blank 280, if needed. The perforated line allows for the blister panel 227 to be optionally removed from the closure panel 242, thereby providing a blister aperture 228.

The closure panel 242 also includes a retention panel 266. In one embodiment, the retention panel 266 is at least partially surrounded by at least one perforated line 272. The perforated line 272 can comprise of a single continuous line. Alternatively, the perforated line 272 can be in the form of multiple perforated lines. The perforated lines 272 allow for the retention panel 266 to be partially removed from the closure panel 242. The retention panel 266 is also partially circumscribed by fold lines 268 and cut line 270. The cut line 270 is disposed proximate to the blister aperture 228, and also opposite the cut line 243. The cut line 243 and the cut line 270 are adapted to receive at least a portion of the blister packaging 260 there through, in one embodiment.

Figure 6:
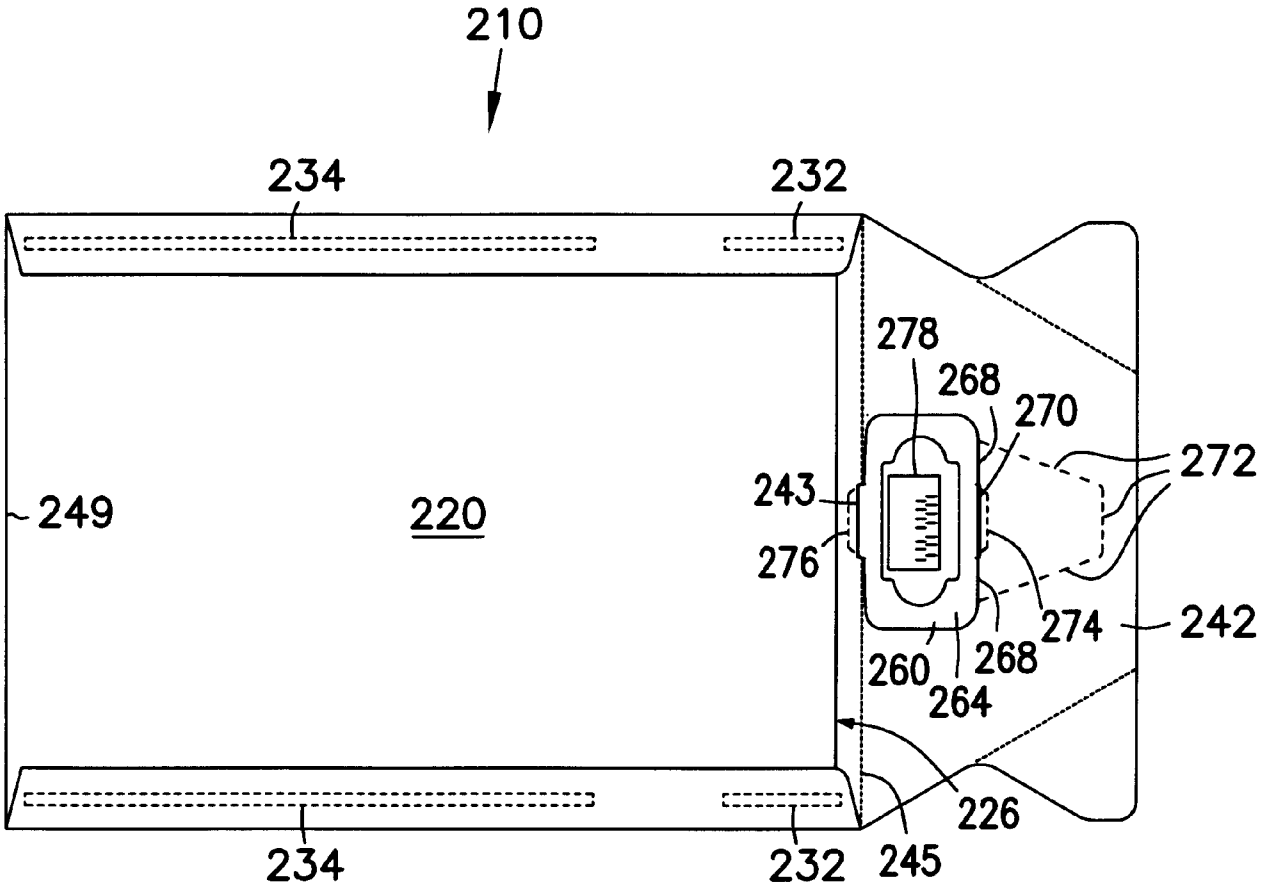
FIG. 6 is a first side elevational view illustrating an envelope constructed in accordance with one embodiment of the present invention.
Figure 7:
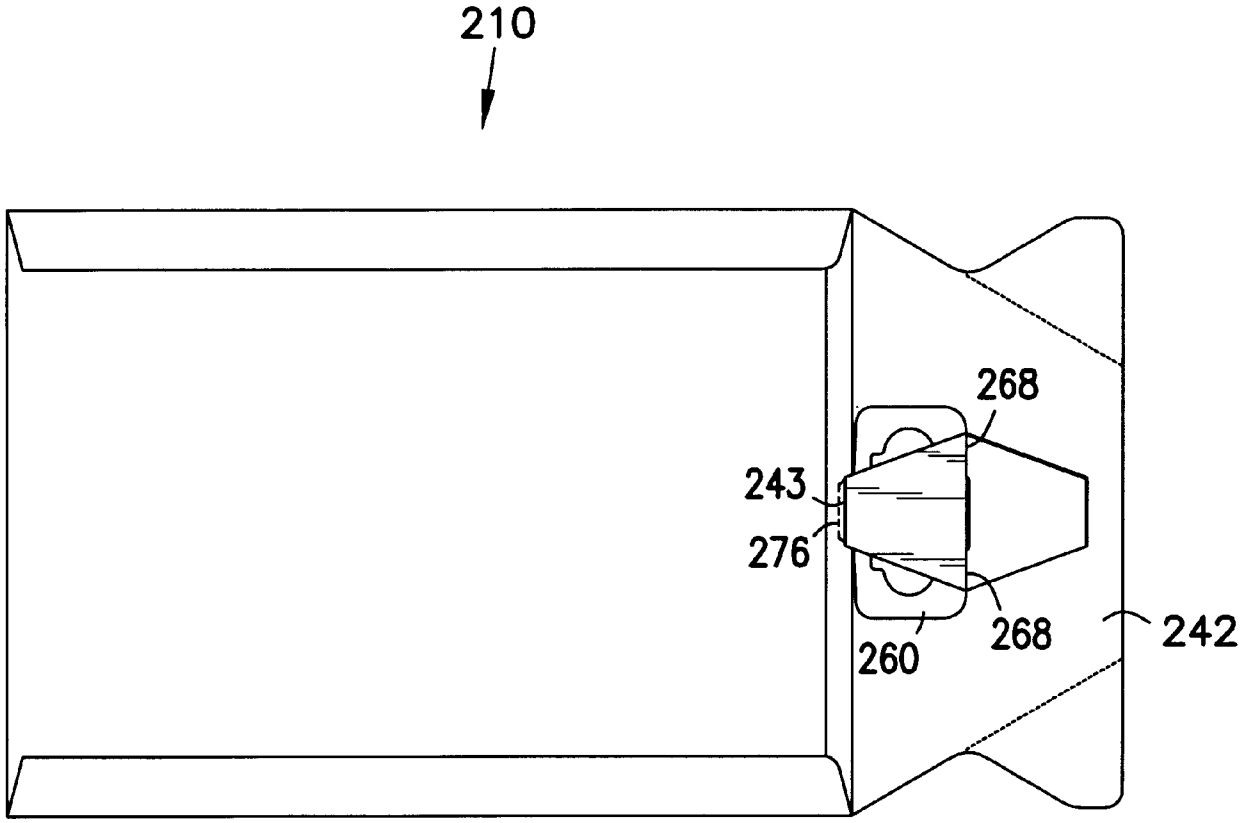
FIG. 7 is a first side elevational view illustrating an envelope constructed in accordance with one embodiment of the present invention.
Figure 8:
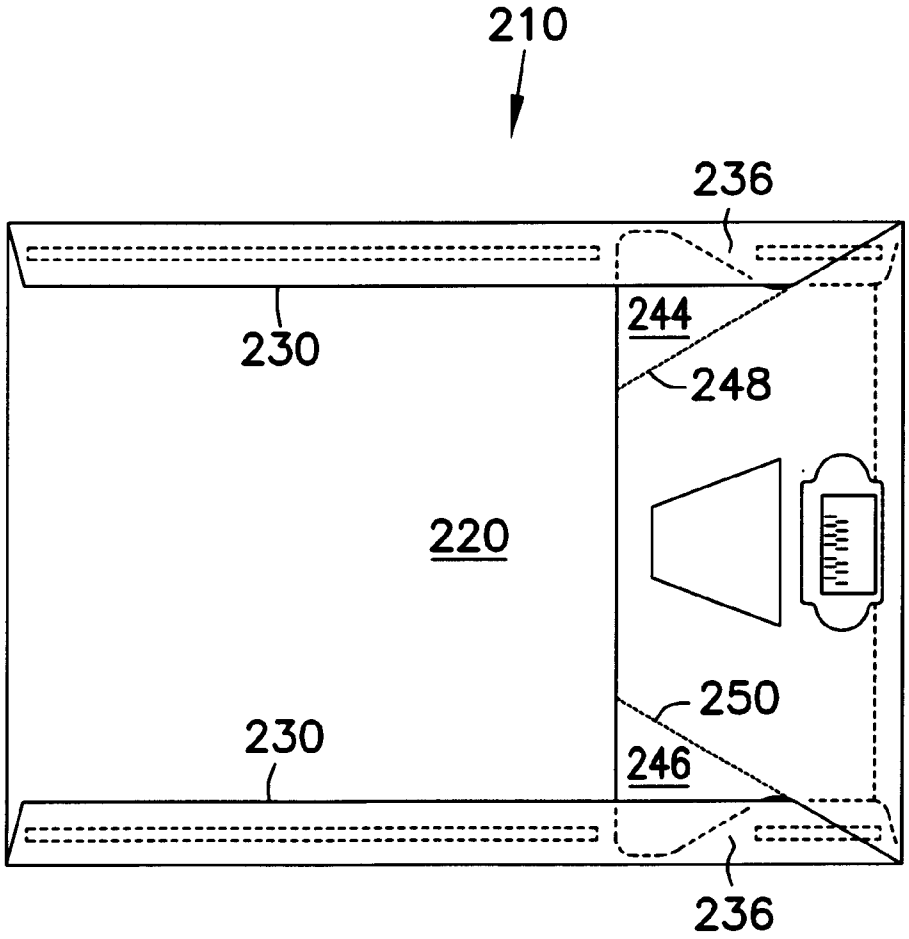
FIG. 8 is a first side elevational view illustrating an envelope constructed in accordance with one embodiment of the present invention.

The blank 280 of FIG. 5 can be assembled into an envelope 210 shown in FIGS. 6 through 8. To assemble the envelope 210, the front panel 220 is folded over fold line 249 against the back panel 240. The side panels 230 are folded over fold lines 247 to attach the side panels to the front panels 220. The back panel, the side panels 230, and the front panel 220 all form a pocket 226 therein. A cassette holder, such as blister packaging 260 can be inserted through the blister aperture 228, if a cassette holder is needed. The blister packaging 260 comprises a structure which has a projection 261 forming a cavity 262 therein. Disposed about at least a portion of the projection 261 of the blister packaging 260 is a retention flange 264. The retention flange 264 facilitates retaining the blister packaging 260 with the envelope 210. Extending from the retention flange 264, in one embodiment, is a first tab 274 and a second tab 276. The first and second tabs 274, 276 are sized and positioned to be received by the cut line 243 and the cut line 270 each of the closure panel 242. The projection 261 of the blister packaging 260 is inserted through the blister aperture 228. The first and second tabs 274, 276 are inserted through the cut line 270 and the cut line 243, respectively. A cassette 278 can be optionally disposed within the cavity 262 within the blister packaging 260. The retention panel 266 of the closure panel 242 is partially removed from the perforated lines 272.

Referring to FIG. 7, the partially removed retention panel 266 is folded over fold lines 268. A top portion 267 of the retention panel 266 is inserted into cut line 243 on top of the second tab 276 of the blister packaging 260 to secure the retention panel 266 over the blister packaging 260. The blister packaging 260 and the cassette 278 are secured to the blister packaging and the closure panel 242 of the envelope 210.

To assemble the envelope 210 as shown in FIG. 8, the closure panel 242 is folded over fold lines 245 and the closure panel 242 is folded towards the front panel 223. The first and second closure tabs 244 and 246 are folded about their first and second fold lines 248, 250, respectively and inserted into the portion without adhesive 236 between the side panels 230 and the front panel 220. Having the first and second closure tabs 244, 246 inserted into the portion without adhesive 236, allows for sealing or closing of the envelope 210 without damage to goods contained therein. In addition, a further advantage is that the blister packaging 260 also does not interfere with any of the items contained inside of the envelope 210. In addition, this embodiment also reduces the amount of cardboard or paper needed to create the blank 280 for the envelope 210.

Figure 9:
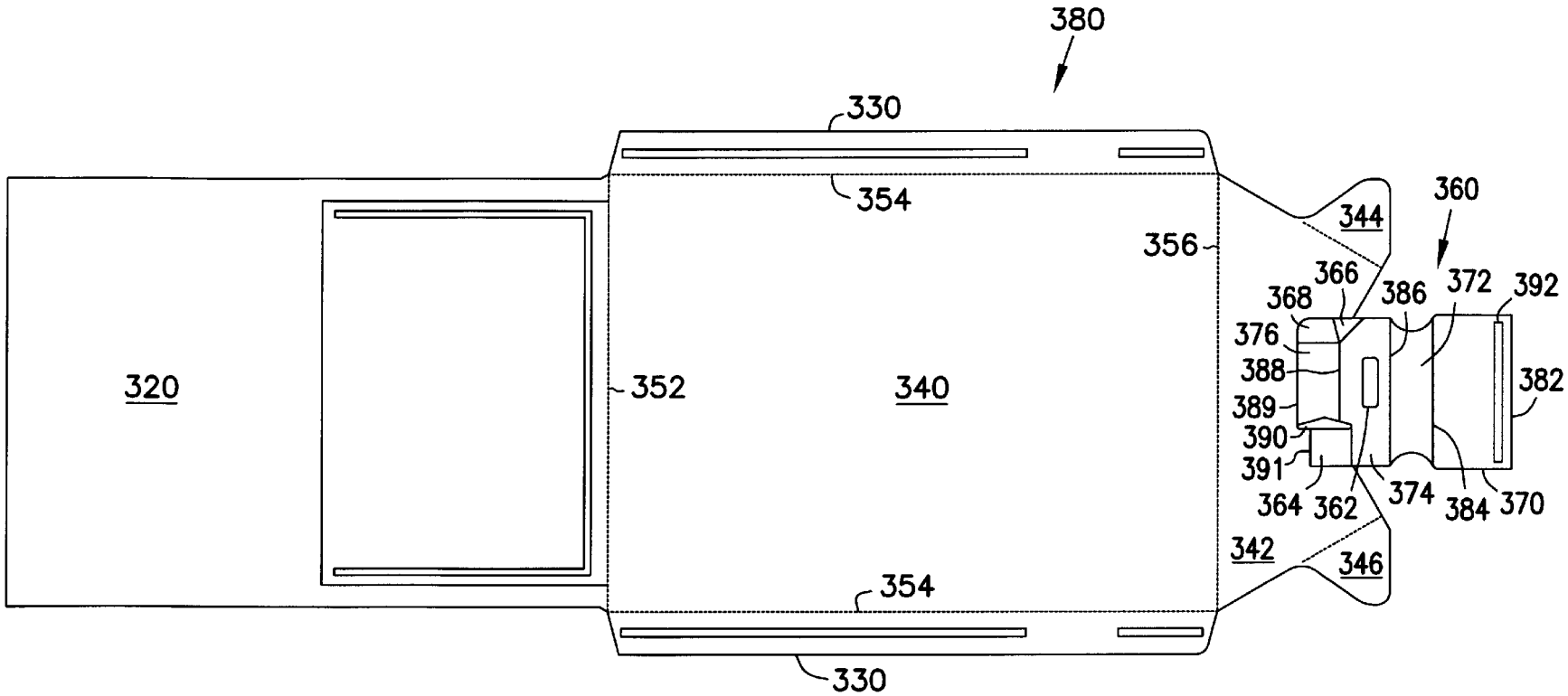
FIG. 9 is a first side elevational view illustrating a material blank for forming a envelope constructed in accordance with another embodiment of the present invention.
Figure 10:
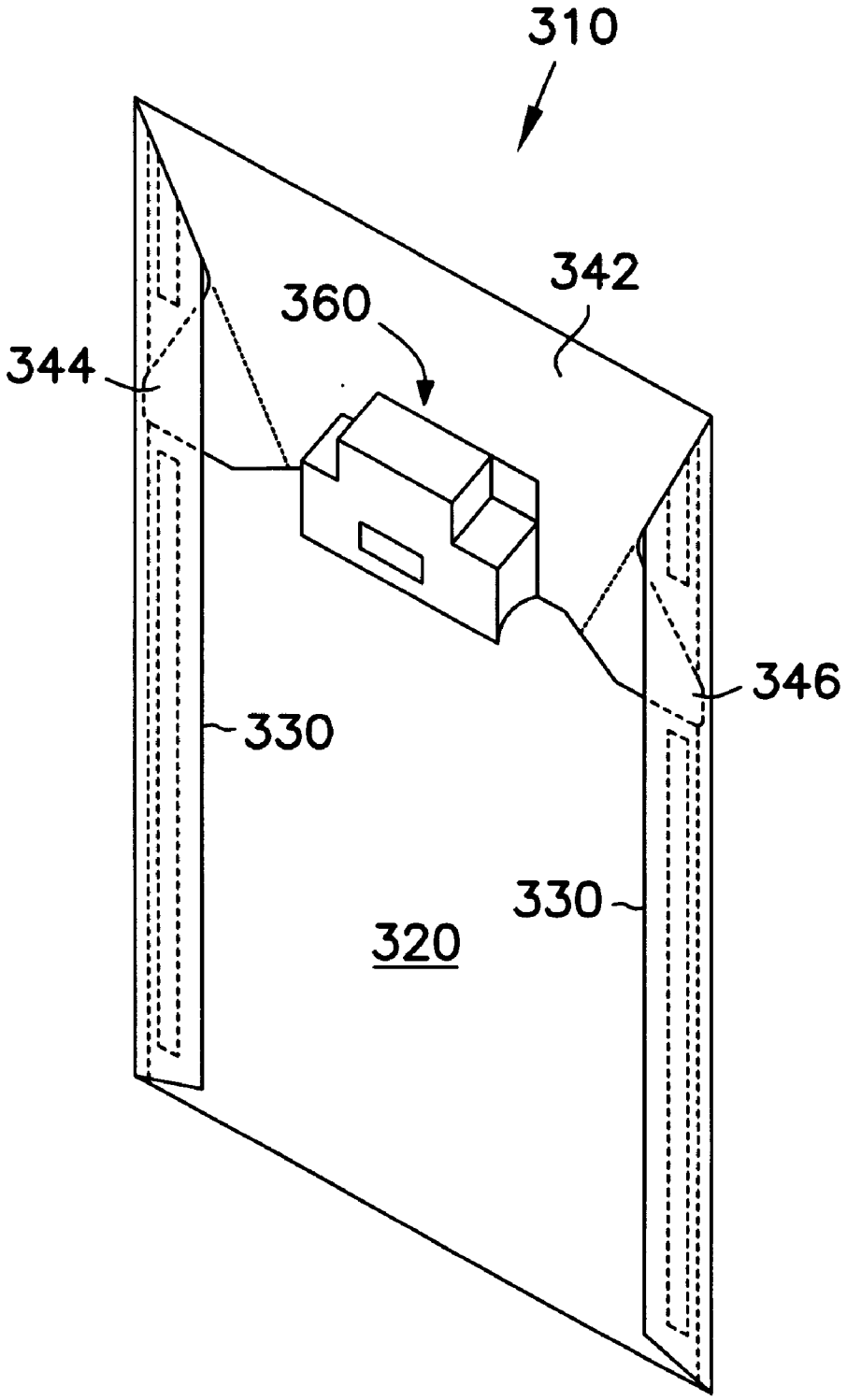
FIG. 10 is a perspective view illustrating an envelope constructed in accordance with one embodiment of the present invention.

FIGS. 9 and 10 illustrate another embodiment of an envelope 310 and a blank 380 for creation of the envelope 310. Referring to FIG. 9, a blank 380 for creating an envelope 310 is shown. A front panel 320 is hingedly coupled to a back panel 340 at fold line 352. The back panel 340 is hingedly coupled with side panels 330 at fold lines 354. In addition, the back panel 340 is hingedly coupled with a closure panel 342 at fold line 356.

Adhesive, in one embodiment, is also disposed on at least a portion of the blank 380. In one embodiment the adhesive is disposed on the side panels 330. Alternatively, the adhesive can be disposed on a portion of the front panel 320, or a combination of the front panel 320 and the side panels 330. In one embodiment, the adhesive comprises a first adhesive strip 332 and a second adhesive strip 334 disposed on each of the side panels 330. In another embodiment, the first adhesive strip 332 is offset from the second adhesive strip 334 creating a portion without adhesive 336 therebetween. Alternatively, in another embodiment, the envelope can be assembled using mechanical fasteners instead of or in addition to the adhesive, and it is still considered within the scope of the invention.

In another embodiment, the blank 380 also includes a cassette holder 360. The cassette holder 360, in one embodiment, comprises a first side panel 370, a second side panel 372, a third side panel 374, and a fourth side panel 376. The first side panel 370, in one embodiment, has a free edge 382 and is hingedly coupled with the second side panel 372 at edge 384. The first side panel 370, and another embodiment, has a strip of adhesive 392 disposed thereon.

The second side panel 372 is hingedly coupled with the first side panel 370 and the third side panel 374 at edge 386, where the second side panel 372 is disposed between the edge 384 and edge 386. In one embodiment, the second side panel 372 has scalloped edges. The third side panel 374 is hingedly coupled to the fourth side panel 376 at edge 388. The fourth side panel 376, and one embodiment, is hingedly coupled with the closure panel 342 at edge 389. In another embodiment the panels are hingedly coupled to each other at score lines. Alternatively, perforated lines, fold lines or an equivalent can also be used. The fourth side panel 376, and yet another embodiment, has an identification aperture 362 therein. Alternatively, the identification aperture 362 can be located in other panels of the cassette holder 360.

Disposed adjacent the third side panel 374 and the fourth side panel 376 is a blocking panel 364. The blocking panel 364 is separated from the third side panel 374 and the fourth side panel 376, and one embodiment by a cut out 390. The blocking panel 364 is hingedly coupled with the closure panel 342, and one embodiment at edge 391 which is disposed between edge 389 and edge 388, and another embodiment. When assembled, the blocking panel 364 prevents a cassette from being inserted past the blocking panel 364 to retain the cassette within the cassette holder 360, as discussed above. In another embodiment, a first security panel 366 and a second security panel 368 are hingedly attached to the fourth side panel 376 and a third side panel 374, respectively. In another embodiment, the first security panel 366 is also hingedly coupled with the second security panel 368. The security panels 366, 368 are adapted to collapse down and close an opposite side of the cassette holder 120, opposite of the blocking panel 364. The cassette contained therein is retained by both the first and second security panels 366, 368 and a blocking panel 364.

To assemble the envelope 310 shown in FIG. 10, the front panel 320 is folded over fold line 352 toward the back panel 340. The side panels 330 are folded over the fold lines 354 and adhere to the front panel 320. To form the cassette holder 360, the first, second, third and fourth side panels are folded over their respective edges to form the holder 360 as shown in FIG. 10. The first and second side panels 370 and 372 are folded over the edge 386, and the adhesive strip 392 secures the first side panel 370 to the closure panel 342. The fourth side panel 376 is folded at edge 389 until it is proximately transverse to the closure panel 342. As the fourth side panel 376 is folded, the blocking panel 364 becomes disposed between the fourth side panel 376 and the second side panel 372, thereby blocking the passage through one side of the cassette holder 360. After a cassette (not shown) is inserted into the cassette holder 360, security panels 366, 368 are folded down to block passage through an opposite side of the cassette holder 360. The closure panel 342 is then folded over the fold line 356 as described in previous embodiments and the first and second closure tabs 344 and 346 are coupled between the side panels 330 and the front panel 320.

The above-described envelopes are intended to be compatible with an existing automated photo processing machine. Therefore, the blanks may be produced from conventional paper product used to produce typical photo print envelope. The blanks, however, are preferably constructed from a relatively sturdy material such as paperboard or other suitable material. Paperboard and/or cardboard is preferred over conventional paper because it is more sturdy and durable. A paperboard envelope also provides better protection and long-term storage for the photo prints and print index held within the envelope and accommodates print of advertising and promotional material on its exterior and interior surfaces. Paperboard is also compatible with existing automated photo processing machines and is, therefore, more desirable than paper envelopes, or other envelopes which are not compatible with automated photo processing machines.

The provided envelope aides in preventing damage from the closure panel to delicate or valuable documents contained inside the pocket of the envelope, without requiring additional material to be added to the envelope. The cassette holder provides a further advantage of securely retaining a cassette within the cassette holder, where the cassette holder is securely attached to the envelope. A further benefit provided are security panels which further secure the cassette with the envelope.

It is to be understood that the above description is intended to be illustrative, and not restrictive. Many other embodiments will be apparent to those of skill in the art upon reviewing the above description. The scope of the invention should, therefore, be determined with reference to the appended claims, along with the full scope of equivalents to which such claims are entitled.

What is claimed is:

1. An envelope comprising:

a front panel hingedly coupled with a back panel;

a side panel hingedly coupled with each side of the back panel and folded over the front panel;

the side panels being at least partially attached to the front panel, each side panel having an unattached portion between each side panel and the front panel;

the front panel, the back panel, and the side panels forming a pocket therein;

at least one closure panel hingedly coupled with the back panel; and each closure panel having at least one closure tab hingedly coupled therewith, the closure tab adapted to be received by the unattached portion between the side panel and the front panel.

2. The envelope as recited in claim 1, wherein the closure panel has two closure tabs, each closure tab being disposed within the unattached portion between the side panel and the front panel.

3. An envelope comprising:

a front panel hingedly coupled with a back panel;

a side panel hingedly coupled with each side of the back panel and folded over the front panel;

the side panels being at least partially attached to the front panel, each side panel having an unattached portion between each side panel and the front panel;

the front panel, the back panel, and the side panels forming a pocket therein;

at least one closure panel hingedly coupled with the back panel;

each closure panel having at least one closure tab hingedly coupled therewith, the closure tab adapted to be disposed within the unattached portion between the side panel and the front panel; and at least one cassette holder coupled with at least a portion of the front panel.

4. The envelope as recited in claim 3, the front panel having a front panel aperture therethrough, the closure panel having a closure panel aperture therethrough, and at least a portion of the cassette holder is disposed through the front panel aperture and the closure panel aperture.

5. The envelope as recited in claim 4, further comprising a retainer panel hingedly coupled with the front panel, the retainer panel being adapted to couple the cassette holder with the front panel.

6. The envelope as recited in claim 3, wherein the cassette holder comprises blister packaging having a projection forming a cavity therein, the cavity being adapted to receive a cassette therein.

7. The envelope as recited in claim 3, further comprising adhesive disposed between each side panel and the front panel.

8. An envelope comprising:

a front panel hingedly coupled with a back panel;

a side panel hingedly coupled with each side of the back panel and folded over the front panel;

the side panels being at least partially attached to the front panel, each side panel having an unattached portion between each side panel and the front panel;

the front panel, the back panel, and the side panels forming a pocket therein;

at least one closure panel hingedly coupled with the back panel;

each closure panel having at least one closure tab hingedly coupled therewith, the closure tab adapted to be disposed within the unattached portion between the side panel and the front panel; and at least one cassette holder coupled with at least a portion of the closure panel.

9. The envelope as recited in claim 8, the closure panel having a blister panel removably coupled therewith, the blister panel being circumscribed by at least one perforated line.

10. The envelope as recited in claim 8, further comprising a retention panel.

11. The envelope as recited in claim 10, wherein the retention panel is folded over the cassette holder and coupled with the back panel.

12. The envelope as recited in claim 11, wherein the retention panel is disposed through a cut line disposed adjacent to the cassette holder.

13. The envelope as recited in claim 8, wherein the cassette holder comprises blister packaging having a projection forming a cavity therein, the cavity being adapted to receive a cassette therein.

14. The envelope as recited in claim 8, wherein the cassette holder comprises a first side panel, a second side panel, a third side panel, and a fourth side panel hinged coupled with each other.

15. The envelope as recited in claim 14, further comprising at least one security panel.

16. A blank for forming an envelope, the blank comprising:

a front panel hingedly coupled with a back panel;

a first side panel hingedly coupled with a first side of the back panel;

a second side panel hingedly coupled with a second side of the back panel;

the first side panel and the second side panel each having adhesive disposed thereon, the adhesive comprising a first adhesive strip and a second adhesive strip, the first adhesive strip being disposed apart from the second adhesive strip thereby creating a portion in between without adhesive;

a closure panel hingedly coupled with the back panel, the closure panel extending from a first end adjacent to the first side panel to a second end adjacent to the second side panel;

a first closure tab hingedly coupled with the closure panel at the first end; and a second closure tab hingedly coupled with the closure panel at the second end.

17. The blank as recited in claim 16, wherein the closure panel further comprises a blister panel removably coupled therewith.

18. The blank as recited in claim 17, wherein the front panel further comprises a cut out adapted for receiving blister packaging therethrough.

19. The blank as recited in claim 16, further comprising a retainer panel coupled therewith.

20. The blank as recited in claim 19, further comprising a cut line disposed adjacent to the retainer panel.

21. The blank as recited in claim 19, wherein the retainer panel is coupled with the closure panel.

22. The blank as recited in claim 19, further comprising a blister panel coupled with the closure panel.

23. The blank as recited in claim 19, wherein the retainer panel is coupled with the front panel.

24. The envelope as recited in claim 1, wherein adhesive is disposed between the side panel and the front panel.

25. The envelope as recited in claim 24, wherein the adhesive comprises a first adhesive strip and a second adhesive strip.

26. The envelope as recited in claim 25, wherein the first adhesive strip is disposed apart form the second adhesive strip having the unattached portion therebetween.

27. The envelope as recited in claim 1, wherein the side panel is attached with the front panel with a mechanical fastener.

* * * * *